United States Patent [19]

Heaton

[11] Patent Number: 4,862,875

[45] Date of Patent: Sep. 5, 1989

[54] LEG EXERCISERS

[76] Inventor: Samuel Heaton, 4 Beacon View,, Embsay, Skipton, N. Yorks., England

[21] Appl. No.: 174,802

[22] Filed: Mar. 29, 1988

[30] Foreign Application Priority Data

Mar. 31, 1987 [GB] United Kingdom ..... 8707591

[51] Int. Cl.[4] ..... A61H 1/02

[52] U.S. Cl. ..... 128/25 B; 128/25 R; 272/96

[58] Field of Search ..... 128/25 R, 25 B, 26, 128/44, 48, 49, 51, 52, 81 R, 80 R; 272/96

[56] References Cited

U.S. PATENT DOCUMENTS 1,833,357 11/1931 Enzler ..... 128/26
2,255,066 9/1941 Lamb ..... 128/25 B
2,413,133 12/1946 Aydelotte ..... 128/48
2,969,060 1/1961 Swanda et al. ..... 128/25 R
3,526,220 9/1970 Small ..... 272/96 X

*Primary Examiner*—Richard J. Apley
*Assistant Examiner*—H. Flaxman
*Attorney, Agent, or Firm*—Fred Philpitt

[57] ABSTRACT

A leg exerciser is for use by a person sitting in a chair. The device is located in front of the chair and the user puts his feet onto two boards which are at an acute angle to the horizontal. A mechanism including a drive motor or flywheel inside the device rocks the boards anti-phase about a horizontal axis lying transverse to the feet between acute angle positions. Sections of the boards lift out of and back into the planes of the boards during each cycle of rocking to lift and lower the user's toes relative to the remainder of the feet so that the feet are subjected to exercise movements similar to walking movements. The exerciser drives the leg blood pump with a view to improving the user's leg circulation.

7 Claims, 3 Drawing Sheets

LEG EXERCISERS

This invention relates to leg exercisers, and has particular although not exclusive application for use by persons who suffer from curculatory ailments in legs, but as the description of the invention proceeds, it will be seen that the device can be used for any person wishing to maintain a good physical condition, particularly in the legs.

The invention was conceived resulting from the medical complaint of poor circulation in the legs. Good circulation of the body and the legs is maintained by regular exercise, in particular the exercise of walking, because the muscles in the calf during the act of walking act as what is known as a "muscle pump" or "blood pump" maintaining good circulation of blood in the veins in the leg, especially maintaining good circulation of blood to the foot. In a person who however takes little exercise during his life and in particular if he has a job which does not involve any physical movement there is a danger that such a person in later life will develop severe leg circulatory problems leading to decay of the tissue of the legs, particularly in the feet area or in extreme cases gangrene in the legs.

Western society has developed modes of life and work which tend to promote a way of life which does not involve such physical exercise, and indeed the most common pastime certainly in the United Kingdom is probably watching television. As a result more and more cases of leg ailments resulting in poor circulation are being reported, and therapy units in hospitals are becoming large or at least are receiving more patients.

The difficulty with taking walking exercise for older persons is that they must inevitably go out of doors which means that they must go out in all weathers, or in the alternative they would have to purchase an exercise machine such as a treadmill machine which is rather expensive on the one hand, and on the other hand is somewhat strenuous to operate.

There is therefore a need for a new form of leg exerciser which can be used at home, but which is not strenuous to operate, and in a preferred arrangement can be used by the user whilst he or she is still in a relatively comfortable position, for example in a seated position, and watching television.

A leg exerciser which at least in its preferred form meets these requirements is disclosed in European Patent Application No. 0205018, and as disclosed in said European Application a leg exerciser comprises at least one foot board, platform or the like on which a foot of the user is placed, said board, platform or the like being mounted for rocking movement, characterised by means for enabling the board, platform or the like to move in a rocking motion to move the ankle in simulated walking motion. Preferably the leg exerciser comprises a pair of feet boards, platforms or the like which are mounted for movement anti-phase back and forth for exercising both legs.

Whilst the leg exercise as described above performs an extremely useful function in exercising the legs, and in particular improving the blood circulation, considerably enhanced effects can be achieved according to the features of the present invention whose function is to provide a leg exerciser which enhances circulation in the leg and in particular the peronial artery and especially the anterior and posterior branches thereof in the region of the heel.

In accordance with the present invention there is provided an exerciser for the leg and foot comprising at least one foot board on which the user's foot is in use placed, and including a toe riser operationally positioned in relation to said board and means for moving the toe riser back and forth for lifting and lowering the user's toe or toes relative to the remainder of the foot.

The board preferably is mounted for cyclic movement so that when the board moves cyclically the user's foot, ankle and lower leg are exercised.

By providing a toe lift which lifts the toe relative to the remainder of the foot, the toe is hinged during the cyclic (preferably rocking) motion of the board, and this has the effect of enhancing the circulation in the peronial artery. The simple exercise of lifting the toe in itself provides stimulating exercise.

Preferably, there are two foot boards arranged side by side and connected so as to be rocked anti-phase, although it is possible to have the boards rocked in phase or at relative angles other than anti-phase, each of said boards preferably has a toe lifter arrangement so that when the respective feet are on the boards and they are rocked, then the toes will be lifted and lowered relative to the remaining portions of the feet, ensuring the exercise of the toes relative to the feet. Such rocking motion combined with the toe lifting, is as close a simulation of the actions through which the feet move in the normal course of walking.

In a particularly suitable arrangement, drive means may be adapted to drive the feet boards, platforms or the like at a frequency in the region of 60–90 cycles per minute and in one specific arrangement, a pair of cranks on a common drive shaft and connecting rods connected to the cranks and boards, platforms or the like are used to drive the boards, platforms or the like in anti-phase.

The drive means may for example be an electric motor with gear box and pulley and belt or chain transmission (or an air motor) connected to the drive shaft, whilst in an alternative arrangement the drive means may include a fly wheel mounted on said common shaft, but in each case, because the drive is applied to maintain the rocking of the board(s), platform(s) or the like the user has to apply little or no effort to maintain the exercise, which means that the user will tend to use the exerciser more diligently than he would were he required to apply effort, as in the case of the known exercisers. A motor and flywheel may be used at the same time.

It is preferred that feet boards, platforms or the like are mounted for a back and forth rocking movement about a common axis and specifically the boards, platforms or the like may comprise two rectangular feet pedals of equal length and said common axis is transverse to the length of the pedals but is spaced closer to the heel end of the pedals than the toe end so that the said axis will be under the hollows of the feet and the rocking simulates walking as close as possible.

The pedals are preferably adapted to rock between two positions when the exerciser is in use, said positions being minimally 15° and maximally 50° to the horizontal.

The exerciser is preferably adapted to be used by a person whilst sitting in a conventional chair and the pedals will be mounted on the exerciser from a safety point of view to prevent the trapping of fingers by the pedals.

The toe lifters will operate cyclically with the rocking movement of the pedals.

In a preferred construction, the or each toe riser may comprise a sub board lying in the same plane as the board and pivotally connected thereto, and a lift rod pivotally connected thereto, said lift rod comprising a stop carried thereby and extending through a lift bar so that as the board rocks, during the cycle the stop contacts the lift bar and causes the sub board to lift thereby lifting the user's toe or toes and as the rocking continues, the stop leaves contact with the lift bar and the sub-board falls back into the plane of the board.

Instead of this construction, other toe lifter mechanisms may be employed. For example the toe lifter mechanism may comprise a cam and a push rod, the cam being rotated with the rocking motion of the board, and the push rods being arranged to lift the toe lifter at an appropriate position in each cycle of rocking each foot board. By this arrangement, the lifting of the toe lifter can be effected at any position in the cycle of rocking movement.

General advantages of the invention in its preferred form are that the walking movement of the foot is carried out including the flexing of the toes, working the muscle blood pump in the calves and in the shin muscles without the weight of the body on the ankle joints, giving nature's lubrication of the working of the ankle ball joints without the body weight, which in my case removed stabbing pains, thought to be a form of arthritis, in the ankle.

Also, the act of making walking movements during exercise periods, without the use of assisted force, twice a day, would require too much strain, and therefore the use of power and/or momentum to give assistance for blood-circulation of the lower limbs is a benefit.

Another advantage of the invention in its preferred form is, that the forces in use while the foot is being exercised are counter balanced and compensating from one foot board to the other. This makes the cost of operating the machine through the use of electricity a very minor consideration.

The exerciser according to the invention causes the user's legs and toe joints to be exercised, preferably simulated walking exercise, whilst the user is not required to put in strenuous effort.

An embodiment of the present invention will now be described, by way of example, with reference to the accompanying diagrammatic drawings, wherein.

Figure 1:
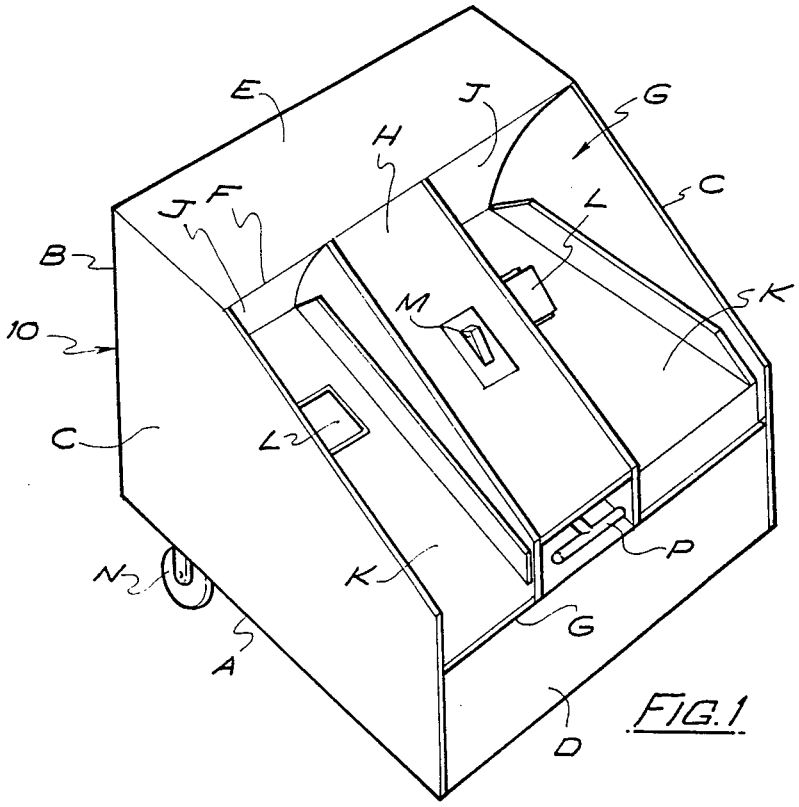
FIG. 1 is a perspective view of a leg exerciser according to the invention.

The leg exerciser according to the embodiment of the invention is shown in perspective elevation in FIG. 1, and is represented by the reference numeral 10. The exerciser comprises essentially a box casing comprising a base A, a back B, sides C, a front D and a top E. The top E extends from the back B forwardly to a position F which is short of a front D, and the front D extends up from the base A to a position G which is short of the plane containing the top E so that in fact the exerciser has a cutaway face G extending from the top to the front in inclined fashion. A centre panel H has cavities J on opposite sides thereof and these cavities receive foot boards K having toe lifter panels L. A switch M serves for switching the machine on and off, and it should be noted that the leg exerciser includes an electric motor for the driving of the pedals K in a rocking fashion as will be described hereinafter. The rear of the base A is supported on wheels N so that the device can be manipulated from place to place by means of a handle P.

The interior of the device shown in FIG. 1 will be described in more detail in relation to the other figures of drawings, but from FIG. 1 it is to be noted that the device is symmetrical about a centre line, and the pedals K are arranged so that the user, whilst sitting in a chair can place his feet comfortably on the pedal surfaces and as the pedals are driven in rocking fashion, so the user's feet and legs will be exercised improving the circulation of blood therein, and during that motion, the toe lifter panels L are periodically raised in order to flex the toes relative to the remainder of the feet thereby further to enhance the exercise and blood circulation effect.

Figure 2:
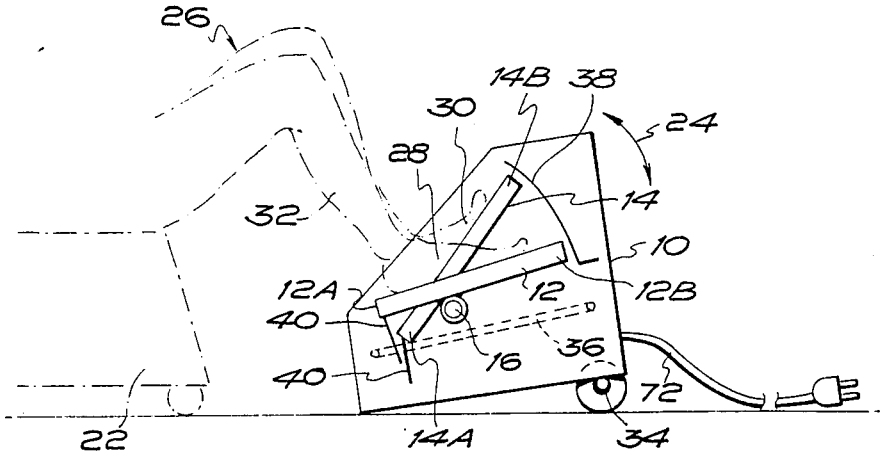
FIG. 2 is a side elevation of an exerciser according to an embodiment of the invention, when in the in-use position, the view omitting certain features in the interests of simplicity.
Figure 3:
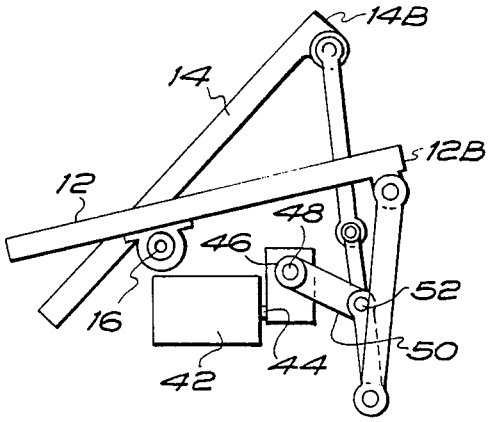
FIG. 3 shows the main components of the drive mechanism of the exerciser as shown in FIG. 1.
Figure 4:
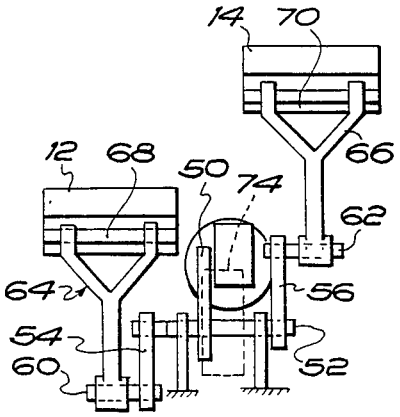
FIG. 4 is an end view of the mechanism shown in FIG. 2.
Figure 5:
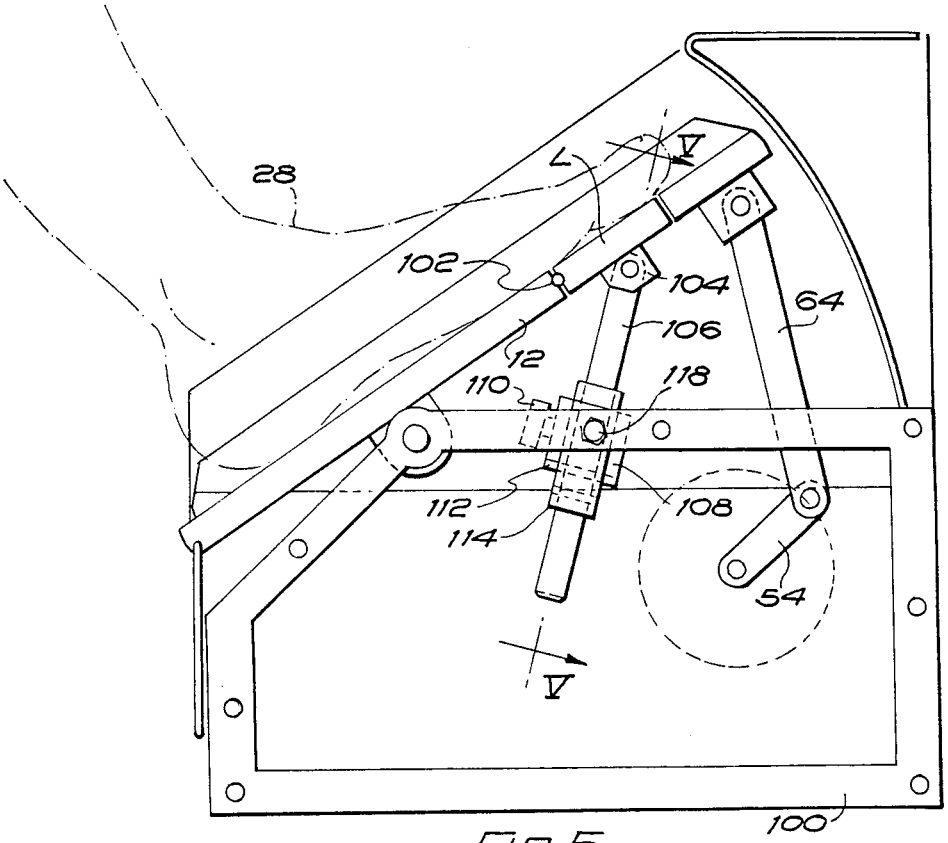
FIG. 5 is a diagrammatic and part sectional side view of the leg exerciser showing the lifter element of one board.
Figure 6:
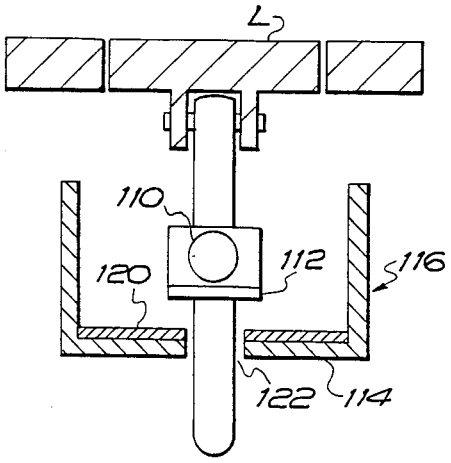
FIG. 6 is a sectional elevation of part of the mechanism of FIG. 5, the section being taken on line VV of FIG. 5.
Figure 7:
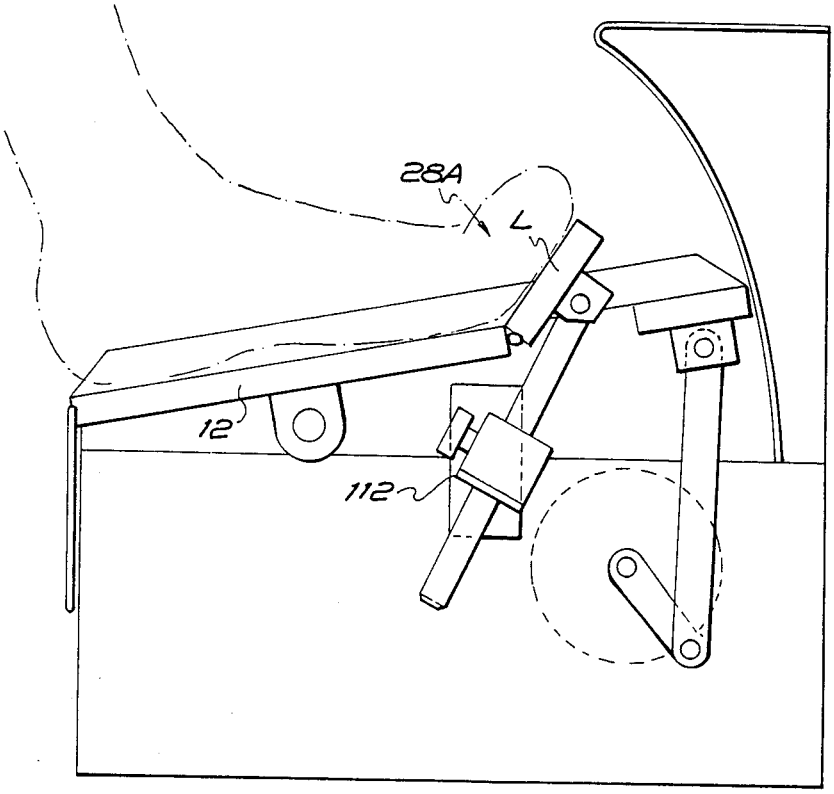
FIG. 7 is a view similar to FIG. 5, but showing the exerciser in a different position.

In the drawings, in the interests of clarity of illustration and description, in FIGS. 2, 3 and 4, the toe lifting platforms and the mechanism for operating these platforms have been omitted, and shown in Figs. 2, 3 and 4 is the mechanism for rocking the pedals. FIGS. 5, 6 and 7 on the other hand illustrate mainly the mechanism for lifting the toe platform, and the components of the rocking mechanism are largely omitted.

Figure 8:
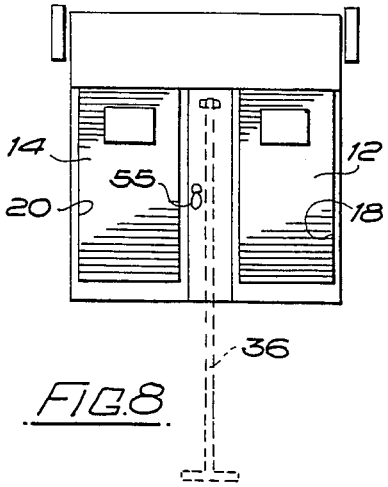
FIG. 8 is a plan view of the exerciser shown in FIG. 1.

In FIG. 2 the leg exerciser 10 is shown as are the two foot pedals 12 and 14 which are mounted for rocking movement about a common axis 16. The pedals 12, 14 as shown in FIG. 8 are arranged to be the bases of cavities 18 and 20 into which the user places his feet respectively as shown in FIG. 2, whilst for example seated in a conventional chair 22.

The pedals 12 and 14 are of rectangular construction and the axis 16 extends transversely of the length direction of each of the pedals, but is located closer the heel ends 12A, 14A of the pedals than the toe ends 12B, 14B so that the axis will be located under the hollows of the feet and the rocking back and forth of the pedals 12 and 14 will cause the feet to articulate and simulate as closely as possible the action of walking. Arrow 24 indicates how the toe ends of the pedals 12 and 14 rock, and during this rocking movement the user's legs 26 (full lines) and 27 (chain dotted line) will be exercised in that the feet 28 and 30 will be rocked back and forth hinging the leg at the ankle region whereby the calf muscles indicated by numeral 32 will be alternately contracted (leg 27 in FIG. 1) constricting internal blood vessels and pumping blood to the feet, and relaxed (leg 26 in FIG. 1) to improve circulation through the leg. At the bottom of the casing to the rear thereof, are provided the wheels 34 and inside the casing is the handle 36 which can be pulled out of the front of the casing as shown in FIG. 8 and by gripping the handle 36 and tipping the casing on its wheels 34 it can be rendered highly manipulable and mobile and therefore it can be moved around a room easily and can also be stored easily.

The pedals 12 and 14 are arranged in the casing 10 to prevent any trapping of the fingers between the pedals and the casing, and to this end the toe ends 12B and 14B sweep close to a curved guide 38, whilst the heel ends 12A are provided with curtain members 40 which overlap the front of the casing. The sides of the pedals as shown in FIG. 8 lie close to the walls of the cavities 18 and 20. The exerciser is therefore rendered safe for use by such features.

FIGS. 3 and 4 show the drive mechanism for the exerciser, and referring to these Figs. it will be seen that the drive mechanism is an electric motor 42 whose output shaft 44 forms the input of a gearbox 46. On the output shaft of the gear box is a pulley or sprocket 48 around which is trained a chain or belt 50. The chain of belt 50 is trained around a pulley on a main crank shaft 52 which carries at the ends thereof a pair of cranks 54 and 56. The drive shaft 52 is mounted on the casing by means of mountings illustrated at 58 in FIG. 4.

The cranks 54 and 56 carry crank pins 60 and 62 on which are mounted connectng rods 64 and 66. At the outer ends the connecting rods are bifurcated to provide two bearings receiving the pivot shafts 68 and 70 which are mounted on the underside of the respective pedals 12 and 14 at the toe ends 12B and 14B thereof.

The cranks 54 and 56 are arranged anti-phase, and it will be clearly understood that upon rotation of the motor 42 which receives electrical power through a lead and plug 72 shown in FIG. 1, for example by throwing an on/off switch 55 at the front of the machine, the output pulley 48 is driven which in turn drives the chain belt 50, which in turn rotates the main crank shaft 52 turning the cranks 54 and 56 which in turn drives the connecting rods 64 and 66, resulting in anti-phase rocking of the pedals 12 and 14.

As the pedals move anti-phase the drive system is in substantial balance, making the requirement for power low. In fact the motor in use draws as little as 0.3 of an amp. As an alternative, an air motor or cylinder may be used.

Referring now to FIGS. 5, 6 and 7, the lifting mechanism for each toe lifter or panel L is shown, but only one toe lifter mechanism is shown, the other mechanism being identical but operated anti-phase to the mechanism shown.

As illustrated in FIG. 5, the machine comprises a steel frame 100 which supports the drive mechanism described in relation to FIGS. 2 to 4, and also supports the toe lifter mechanism and the various panels of the exerciser as shown in FIG. 1 are screwed or otherwise secured to the frame 100 so that the panels can be removed easily for examination and repair of the internal mechanisms. The rear panel for example may co-operate with a limit switch which is included in the electrical supply circuit so that if the said panel is removed, the switch automatically breaks the circuit and the motor cannot be started which adds to the safety of the machine.

As can be seen from FIG. 5, the toe lifter panel L is formed as part of the pedal board 12 and is pivoted thereto about pivot axis 102. To the underside of toe lifter board L is a bracket 104 to which is pivotally connected a push rod 106. Push rod 106 carries a stop in the form of a bush 108 which is connected to the push rod by means of a gripping screw 110. To the underside of the bush is a rubber bumper 112 the purpose of which will be described hereinafter. The rod 106 passes freely through the cross leg 114 of a U-shaped reaction bracket 116 (see FIG. 6) which is fixed to the frame 100 for example by bolts 118. On the upper surface of the cross piece 114 is a ruber layer 120 which is impacted by the bumper 112 during the operation of the machine as will now be described.

As will be understood from FIGS. 5 and 7, when the pedal board 12 is in the uppermost position as shown in FIG. 5, and the user's foot 28 is positioned thereon, the foot lies as indicated with the toes over the lifter panel L which lies in the plane of the board. As the mechanism rocks the pedal 12 to the position shown in FIG. 7, so the push rod 106 is pushed downwardly through the aperture in the bracket 116, and in this connection it should be noticed that the aperture 122 must be of sufficient clearance to allow the rod 106 to slide through the bracket and also to pivot relative to the bracket. The aperture may therefore be an elongated slot. The rod 106 slides downwardly until the bumper 122 contacts the rubber strip 120 when further movement of the rod 106 is terminated. With the continued rocking movement of the board 112, so the lifter panel L is lifted as shown clearly in FIG. 7 causing the user's toes to be lifted upwardly as shown at 28A in FIG. 7, thereby exercising the toes as well as the ankle and leg, and making the simulation of walking movement even more efficient.

As the drive mechanism continues to rotate, so the foot once more reaches the FIG. 5 position and the lifter L drops back to a position in the plane of the pedal 12. It will be appreciated that both feet are exercised in similar fashion but in anti-phase relationship.

All of the bearings used in the drive mechanism are preferably of Nylon and require no oiling or greasing and the mechanisms may include rubber isolating bushes to cut down noise during operation.

The transmission may be made adjustable so that the frequency of operation of the pedals can be adjusted and all electrical connections will be earthed.

Instead of using the motor 42, gearbox 46 and drive chain or belt 50, there may be a fly wheel 74 shown in dotted lines in FIG. 4 mounted on the main crank shaft 52. The initial motor power for rocking the pedals is supplied by the user, but the fly wheel maintains the kinetic energy of the system whereby the user is not required to apply any more energy than is necessary to keep the pedals rocking. A flywheel can be used in conjunction with the motor if required.

The transmission system is typically designed to give a rocking frequency of the pedals 12 and 14 of the order of 60 to 80 cycles per minute and more specifically 64 to 72 cyles per minute.

It is possible to arrange for the drive system to be of variable speed if it is required to have different frequencies of rocking, and this may be done by making the motor 42 a variable speed unit.

Although the invention has been described in the example as providing that the pedals rock about a common axis, in other embodiments they may be arranged to move linearly or in a complex movement involving linear and rocking movement.

Any suitable materials may be used for the fabrication of the exerciser such as fibreglass, plastics, metal or wood. The surfaces of the pedals are preferably covered with non-slip material such as rubber having a ribbed or other embossed pattern.

The apparatus of the embodiment described has a considerable advantage of that the user may use same whilst in a seated position, and therefore it is usable whilst working at a desk or watching television, and therefore it will require little discipline or effort on the part of the user to make regular use of the exerciser. Regular use is of course most desired in order to keep the muscle pump well exercised to improve the blood circulation.

The expression anti-phase as used herein is intended to mean at some time during use of the exerciser one pedal is moving in one direction whilst the other pedal is moving in the opposite direction rather than the specific operational meaning that one pedal is 180° out of phase with the other at all times although this meaning clearly is to be included.

Also, in modified forms of the invention where the pedals rock, the pedals can be in phase or indeed the exerciser may only have one pedal, the user exercising one leg at a time.

The invention also includes an arrangement provided with only a toe lifter for one or for each foot, and a mechanism or means for lifting the toe or toes of one or each foot.

We claim:

1. An exercise machine for the leg and foot comprising (a) a casing adapted to stand on the floor, (b) means defining a horizontal rocking axis in the casing, (c) a footboard positioned to receive the foot in a predetermined position and mounted on said rocking axis for rocking movement, (d) means limiting the rocking of the footboard on said rocking axis between first and second acute angle positions, (e) a sub-board defined in said footboard at a forward end thereof in the region where the user's big toe is to be located, said subboard being displaceable relative to the plane of the footboard, (f) a push rod connected to the underside of said sub-board, and (g) means effecting pushing of said rod and displacement of said sub-board upwardly relative to the plane of the footboard as the footboard rocks from the first and greater acute angle position to the second and lesser acute angle position to articulate the user's big toe relative to the foot while the foot is articulated relative to the leg by the rocking of the board, whereby simulated walking movements of the foot and toe are effected by the machine.

2. An exercise machine according to claim 1 including two of said footboards arranged side-by-side whereby means is provided for receiving a user's feet.

3. A leg exercise machine according to claim 2 wherein a means is provided for rocking the footboards antiphase.

4. An exercise machine according to claim 2 which includes a crank mechanism coupled to each board.

5. An exercise machine according to claim 4 which includes an electric motor connected to said crank mechanism so as to rock said footboard or footboards back and forth.

6. An exercise machine according to claim 5 which includes a flywheel connected to said crank mechansim so as to maintain rotation of said crank mechanism and the rocking of said footboard or footboards.

7. An exercise machine according to claim 2 wherein a means is provided for adapting the machine for use by a person sitting in a chair, the footboard or footboards being arranged at an acute angle and arranged to be rockable between acute angles to the horizontal to receive a user's foot or feet so that it or they will be in a comfortable position.

* * * * *